US006823547B1

(12) United States Patent
Harding et al.

(10) Patent No.: US 6,823,547 B1
(45) Date of Patent: Nov. 30, 2004

(54) BABY MATTRESS WITH INTEGRAL LIFE CRADLE

(76) Inventors: Diane Harding, 10455 Oakdale Ave., Suite A, Chatsworth, CA (US) 91311; Joseph P. Burke, 10455 Oakdale Ave., Suite A, Chatsworth, CA (US) 91311

( * ) Notice: Subject to any disclaimer, the term of this patent is extended or adjusted under 35 U.S.C. 154(b) by 0 days.

(21) Appl. No.: 10/666,670

(22) Filed: Sep. 19, 2003

(51) Int. Cl.[7] ..... A47C 20/02
(52) U.S. Cl. ..... 5/655; 5/706; 5/710; 5/655.3
(58) Field of Search ..... 5/706, 710, 655, 5/655.3, 655.9, 630, 631

(56) References Cited

U.S. PATENT DOCUMENTS 4,737,999 A * 4/1988 Halverson ..... 5/710
4,819,287 A * 4/1989 Halverson ..... 5/710
5,237,712 A * 8/1993 Ramsay ..... 5/710
6,408,470 B1 * 6/2002 Powers ..... 5/735

* cited by examiner

*Primary Examiner*—Teri Pham Luu
(74) *Attorney, Agent, or Firm*—James F. Cottone

(57) ABSTRACT

An improved baby mattress is formed of four sections, with a two part central section including a pair of interactive cradles which provide safe and comfortable support for a sleeping infant. An upper life cradle area may be variably pressurized to produce a telescoping well which encourages placing the infant for safe sleeping on its back. A lower safety cradle is filled with strong and resilient foam rubber and serves to safely support the infant in the event of unwanted cradle deflation. An array of auxiliary support and shape retaining members serve to give the crib-sized mattresses a stable and smooth overall rectangular appearance.

10 Claims, 1 Drawing Sheet

BABY MATTRESS WITH INTEGRAL LIFE CRADLE

TECHNICAL FIELD

The present invention relates generally to an inflatable air mattress specially adapted for promoting safe and healthy sleep for infants, and more particularly to a multi-chambered air mattress that includes a separately inflatable life cradle and safely cradle combination which is centrally positioned in the mattress to encourage and condition infants to sleep on their backs.

BACKGROUND

Methods and apparatus for promoting safe and healthy sleep for infants have been the subject of a significant amount of serious thought and development over the years. Baby mattresses, crib sleeping arrangements and bedding apparatus of all types have evolved over many years leading to a good amount of innovative and inventive techniques. Virtually all of these approaches address one or more of the basic sleep needs—infant comfort, healthy support and infant safety. In recent years a new factor has emerged to render many of the previously accepted techniques and devices of questionable safety value. Specifically, Sudden Infant Death Syndrome (SIDS) has been found to be a major consideration regarding how infants' sleeping arrangements are viewed, beyond the traditional comfort and support aspects. Prone sleeping is associated with spontaneous face-down sleeping in infants. The face-down position is associated with rebreathing expired gases, including carbon dioxide, and increased carbon dioxide lung pressure in normal infants. In some cases the amounts are sufficient to cause infant death [J. Pediatrics, Vol. 123, p686 (1993)]

While many babies need the security of being snugly wrapped in a blanket, and many people use towels, blankets, stuffed toys and the like to brace or secure their infants, it has recently been recommended that infants should preferably be conditioned to sleep on their backs. And further preferably on a firm mattress with no soft items near them. Indeed, the chairman of the American Academy of Pediatrics' Task Force recommends that babies sleep on their backs. The same recommendations also come from the SIDS Alliance. The reasoning is to allow for greater circulation of breathing air. Pillows, however, are typically very soft and assume the contour of the overlying infant. Consequently, there is a danger that the infant may suffocate if the child's face becomes directed toward the pillow.

Descriptions of typical prior art approaches may be found in a number of U.S. patents.

U.S. Pat. No. 5,855,031 to Swift, Jr. teaches the use of a mesh hammock which is supported a short distance above a baby crib mattress so that infants may more safely sleep on their stomachs.

U.S. Pat. No. 5,439,008 to Bowman proposes an infant restraint apparatus wherein pairs of side straps are secured to a wedge-shaped support member which is positioned on a slanted angle within a baby crib.

U.S. Pat. No. 3,042,941 to Marcus provides a teaching of including a sponge rubber body within an inflatable mattress chamber. The sponge body stands on a number of legs (four are shown) and is used in combination with an inlet valve to aid in inflation of the mattress.

U.S. Pat. No. 6,233,768 to Harding discloses a maternity mattress having an adjustably sized womb well suitably positioned within the mattress to support comfortable sleep for women as their pregnancy progresses.

While each of these prior art devices and approaches functions more or less well, they have not to date provided an optimum solution to the recently recognized needs of baby sleeping accommodations. This is especially the case regarding conditioning and encouraging babies to sleep on their backs to minimize SIDS risk. This is also the case regarding contemporary needs for infant sleeping accommodations calling for mobility for travel so that a baby will always have its own safe, comfortable and familiar personal mattress. It is exactly this set of needs that the present invention admirably meets.

OBJECTS OF THE INVENTION

It is therefore a primary object of the present invention to provide an improved multiple section inflatable mattress for infants which will overcome the disadvantages of the prior art methods and apparatus.

A further object of the present invention is to provide an improved infant mattress having a central section which includes a life cradle area disposed above a safety cradle to safely and comfortably support a sleeping infant.

A yet further object of the present invention is to provide a life cradle area which may be variably inflated so as to accommodate an infant as the infant grows, with the life cradle positioned above a safety cradle which is filled with strong and resilient material to support an infant in the event of unwanted cradle deflation.

In a preferred embodiment, a baby mattress is formed to include a number of separately inflatable sections. A pair of mirror image end sections enclose a central section made up of two vertically disposed cradles which produce the unique and valuable features afforded by the invention. The uppermost life cradle area portion of the central section may be inflated at various pressures to produce a telescoping well variable in size and stiffness. Beneath the life cradle there is positioned an inflatable safety cradle portion of the central section which is filled in substantial part with a firm and durable foam rubber element. The safety cradle serves to safely and smoothly support an infant in the event of unwanted deflation of either of the cradles, The baby mattress further includes a number of auxiliary elements—such as baffles, gussets and height limiting ribbons, and the like—to provide integrated dynamic and static support for both the mattress itself and the mattress/infant combination.

BRIEF DESCRIPTION OF THE DRAWINGS

Additional objects and advantages of the invention will become apparent to those skilled in the art as the description proceeds with reference to the accompanying drawings, wherein.

BEST MODE FOR CARRYING OUT THE INVENTION

Figure 1:
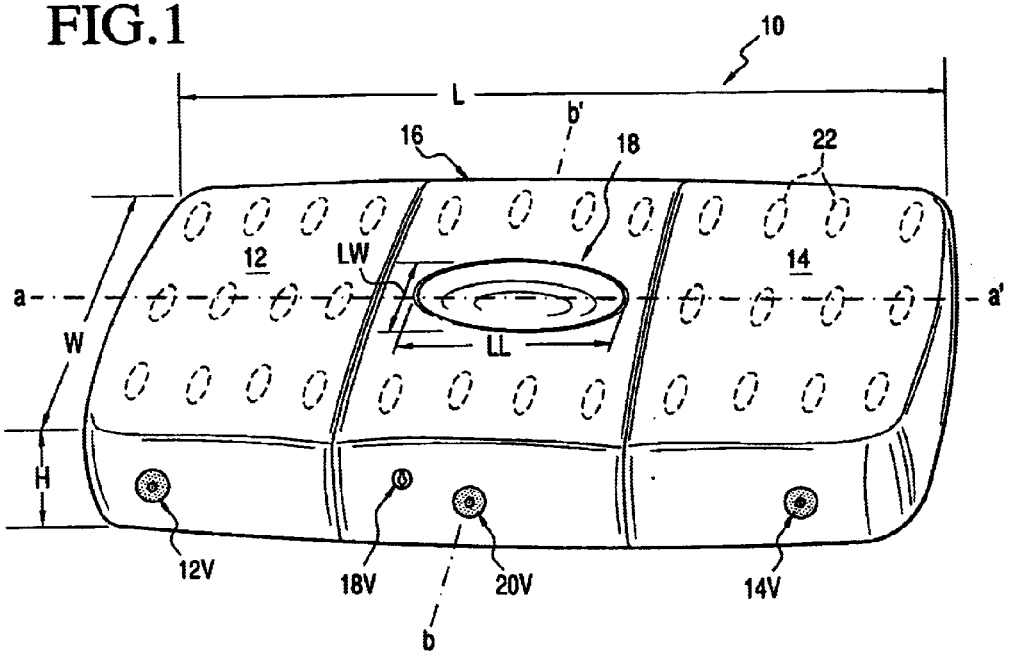
FIG. 1 is a top front perspective view of a multiple chambered baby mattress incorporating the life cradle/safety cradle combination according to the present invention.

Referring now to FIG. 1, there is shown a top perspective view of a baby mattress having multiple separately inflatable chambers or sections according to the present invention. By way of a brief overview, and with additional reference to the horizontal cross sectional view of FIG. 2, a baby mattress 10 is shown as having a pair of end regions or sections 12 and 14 between which is located a central section 16. The two end sections may be mirror image symmetrical, and the central section is shown as having a partially inflated life cradle area 18 at its mid region. As will be described in detail below, the life cradle area 18 forms a telescopic well that may be adjustable via its own separate air valve to accommodate the changing size needs of a growing infant. The life cradle area 18 is positioned above and is integrally connected to a separately inflatable safety cradle 20. The lower layer of the life cradle chamber is integrally formed with the upper layer of the safety cradle chamber, and the two chambers cooperate, especially in the vertical or height dimension, to achieve the unique and useful functions provided by the present invention. These several air chambers—12, 14, 18 and 20—are fully interconnected to form a unitary mattress, with the overall dimensions of L, W and H as shown.

The baby mattress 10 is shown as being of generally rectangular form, having its length L taken along a longitudinal central axis a–a', its width W taken along an orthogonal, transverse axis (now shown), and its height H taken between its nominal top and bottom surfaces. The three major sections 12, 14 and 16 include a plurality of rigidifying baffles 22 whose top surface attachment lines are shown in dashed lines in FIG. 1, and in vertical cross section in FIG. 2. As is well known, air mattresses generally, as well as water mattress and similar fluid-filled flexible devices, exhibit highly undesirable supporting instabilities when carrying dynamic loads, such as a moving person. These instabilities are particularly undesirable when supporting infants because it is very difficult for the infant to achieve a stable and comfortable sleeping position. The slightest user motion triggers off mattress shape/user weight flexing interactions that negate the comfort previously achieved. It is exactly these instabilities—dynamic and static—that the array of baffles (36 of them, illustratively) provide. For a fuller description of the dimensional stability and other benefits afforded by the array of baffles 20, the interested reader is referred to the description contained in the commonly owned U.S. Pat. No. 6,233,768 granted on May 22, 2001.

Figure 2:
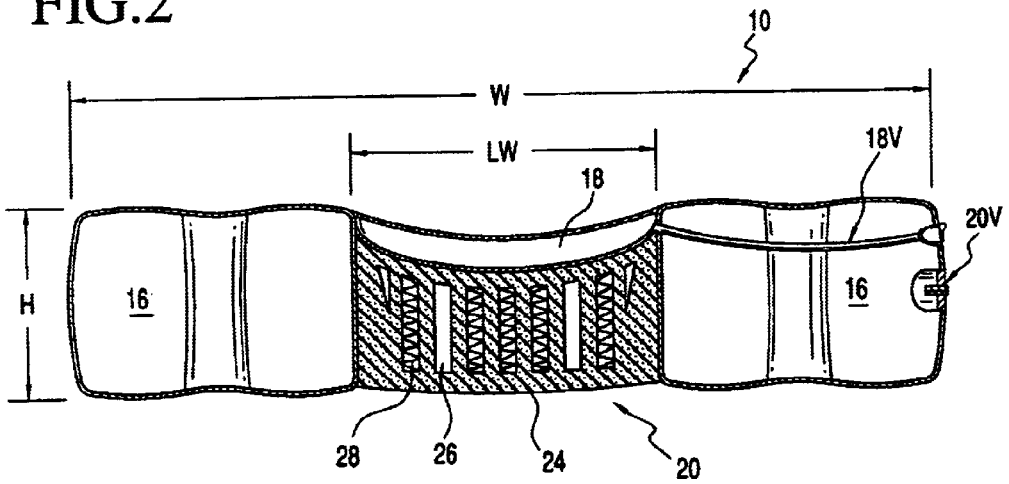
FIG. 2 is a vertical cross sectional view of the baby mattress taken along the line b–b' of FIG. 1.

With continued reference to FIGS. 1 and 2, and especially to the cross sectional view, the safety cradle 20 is filled with strong and durable foam rubber material 24, which is skeletonized by a number of vertically disposed air passages 26, thereby becoming a uniquely structured support element. The combination of the pressurized air and the material strength and stiffness of the foam rubber 24 provides support under the life cradle 18. Note that the upper surface of the foam rubber element 24 is concavely shaped. In the event of accidental or unwanted deflation of one or more of the cradles, the foam rubber 24 would gently and safely support the weight of the baby.

Positioned interiorly of the air passages 26 are a number of height limiting ribbons or straps, of which the ribbon 28 is typical. The quantity and distribution of these limiting ribbons may be varied to achieve a desired amount of height control. The ribbons 28 are made of non-stretchable material and have their top and bottom ends affixed respectively to the tops (ceilings) and bottoms (floors) of their corresponding air passages. In use, as the safety cradle is inflated to a suitable pressure, the ribbons 28 restrain the foam rubber 24 in height so as to allow cradle inflation, but prevent the top surface of the mattress from billowing up, and of course preserving the concave shape of the foam rubber element 24.

The life cradle area 18 also has its own air inflation valve 18V, via which a variable amount of air pressure is introduced to adjust the size and stiffness of the mattress surface so as to provide the desired telescoping well (i.e., size, depth and stiffness adjustability) effect. Note the elliptical shape of the well and the relative dimensions of it with respect to the central section 16, as best seen in FIG. 1. The semi-major ellipse axis (not shown) of the life cradle telescoping well is oriented along the longitudinal axis a–a'. FIG. 2 best shows the telescoping well set to approximately equal the concavity of the safety cradle 20 upper surface. This telescoping well is designed so that it conforms to the needs of a growing infant, and may be deflated from time to time to prevent the infant from turning onto its stomach. Thereby, the infant is positioned comfortably and supported snugly on its back using only the inflatable life/safety cradle combination. This structure assures that care givers who are not aware of the advantages of keeping a sleeping infant on its back will correctly position the baby in the telescoping well area.

In various preferred embodiments, the baby mattress 10 may be provided in differing sizes corresponding to more or less standard crib sizes commonly encountered. Some primary U.S. sizes are designated as "Crib/Jr. Bed", "PortaC-rib" size and "Bassinet" size. A typical preferred size is contemplated as being approximately 52" in length, 28" wide and 6" high. The construction and fabrication of the various sections, chambers, valves, and so forth may be accomplished using well known and conventional fabrication techniques. For example, heat welding, adhesive sealing and reinforcing stitching or fastening means are commonly used. While the life cradle may be fabricated with the overall length LL and width LW dimensions of 14 and 10 inches, respectively, at the top surface of the baby mattress 10, alternate embodiments are contemplated wherein these dimensions may be altered. Alternate embodiments also contemplate not only different overall mattress sizes and shapes, but also alternate fabrication techniques. For example, the two end sections may be fabricated into a commonly air filled chamber.

Although the invention has been described in terms of preferred and alternate embodiments, the invention should not be deemed limited thereto since other embodiments and modifications will readily occur to one skilled in the art. It is therefore to be understood that the appended claims are intended to cover all such modifications as fall within the true spirit and scope of the invention.

What is claimed is:

1. A multiple chambered mattress for promoting safe and healthy sleep for infants comprising:

(a) a pair of end sections;

(b) a central section affixed to and positioned between said end sections, said central section having an upper life cradle affixed to and located above a lower safety cradle;

(c) said life cradle being separately inflatable so as to provide a variably sized telescoping well for supporting an infant; and (d) said safety cradle being separately inflatable and containing a firm resilient material element so as to support an infant in the event of unwanted cradle deflation.

2. The infant mattress of claim 1 wherein said end sections and life cradle and safety cradle are separately air inflatable, said end and central sections are arrayed along a longitudinal axis passing serially through the mid sections of a first of said end sections and through said central section then through a second of said end sections.

3. The infant mattress of claim 2 wherein said telescoping well is elliptical in horizontal cross section with its semi-major axis longitudinally oriented.

4. The infant mattress of claim 3 wherein said firm resilient material is foam rubber so as to provide strong and durable support for the weight of an infant.

5. The infant mattress of claim 4 wherein said foam rubber includes a plurality of air passages, a number of said passages containing a height limiting ribbon, so as to limit vertical extent of said safety cradle in the event of overinflation.

6. The infant mattress of claim 5 wherein the upper surface of said safety cradle is concavely shaped so as to present a concave lower supporting surface to said life cradle.

7. The infant mattress of claim 1 wherein said pair of end sections and a portion of said central section include a plurality of baffles distributed throughout their interior regions, each of said baffles extending between an underside surface of a top surface layer of said sections and an upper side surface of a bottom surface layer of said sections so as to enclose an air volume in fluid communication with the air in said sections.

8. A method of safely and comfortably supporting a baby for sleep comprising:

(a) providing a multiple section inflatable mattress having first and second end sections with a central section affixed to and positioned therebetween;

(b) providing a life cradle area as an integral upper portion of said central section, said life cradle being separately variably air inflatable thereby providing an adjustably sized telescoping well for supporting a baby; and (c) providing a safety cradle as an integral lower portion of said central section, said safety cradle affixed to said life cradle and being separately air inflatable, said safety cradle containing a foam rubber element thereby providing a safe baby supporting capability in the event of unwanted deflation of either of said cradles.

9. The method of claim 8 wherein said telescoping well is elliptical in cross section with its semi-major axis oriented along a longitudinal mattress axis taken along a line passing serially through the mid regions of a first of said end sections and said central section then through a second of said end sections.

10. A multiple chambered mattress for promoting safe and healthy sleep for infants comprising:

(a) a pair of air inflatable end sections;

(b) a central section affixed to and positioned between said end sections, said central section having an upper life cradle affixed to and located above a lower safety cradle;

(c) said life cradle being separately air inflatable so as to provide a variably sized telescoping well for supporting an infant;

(d) said safety cradle being separately air inflatable and containing a firm resilient material element so as to support an infant in the event of unwanted cradle deflation;

(e) a longitudinal mattress axis oriented along a line passing serially through the mid regions of a first of said pair of end sections and through said central section and then through a second of said pair of end sections;

(f) said telescoping well is elliptical in horizontal cross section with its semi-major axis longitudinally oriented; and (g) whereby upon controllably inflating said life cradle the volumetric size and the stiffness of said telescoping well may be adjustably controlled for infant support and comfort while encouraging and conditioning an infant to sleep on its back.

* * * * *